US005816507A

United States Patent [19]

Skali Lami et al.

[11] Patent Number: 5,816,507

[45] Date of Patent: Oct. 6, 1998

[54] DEVICE FOR FORMATION OF A FAN JET OF LIQUID

[75] Inventors: Salah Skali Lami, Richard Menil; Gérard Cognet; Jean-Marie Pierrard, both of Biviers, all of France

[73] Assignees: Centre Technique de l'Industrie des Papiers, France; Valmet Corporation, Finland

[21] Appl. No.: 624,386

[22] PCT Filed: Jul. 31, 1995

[86] PCT No.: PCT/FR95/01028

§ 371 Date: Apr. 5, 1996

§ 102(e) Date: Apr. 5, 1996

[87] PCT Pub. No.: WO96/05369

PCT Pub. Date: Feb. 22, 1996

[30] Foreign Application Priority Data

Aug. 10, 1994 [FR] France ..... 94 10055

[51] Int. Cl.[6] ..... D21F 1/02

[52] U.S. Cl. ..... 239/590; 239/597; 162/341

[58] Field of Search ..... 239/597, 590.5, 239/590, 553.5; 162/336, 339, 341, 342

[56] References Cited

U.S. PATENT DOCUMENTS

| | | | |
|---|---|---|---|
| 2,329,799 | 9/1943 | Thorsen | 162/339 X |
| 2,451,305 | 10/1948 | Shannon . | |
| 2,756,651 | 7/1956 | Lee | 162/342 X |
| 3,228,067 | 1/1966 | Strong et al. | 162/342 X |
| 4,031,013 | 6/1977 | Skretting | 162/342 X |
| 4,376,014 | 3/1983 | Bergstron | 162/341 X |
| 5,100,513 | 3/1992 | Crawford | 162/342 |

FOREIGN PATENT DOCUMENTS

| | | | |
|---|---|---|---|
| 1008564 | 5/1957 | Germany . | |
| 47/17722 | 5/1972 | Japan | 162/342 |
| 859145 | 1/1961 | United Kingdom . | |

*Primary Examiner*—Kevin Weldon
*Attorney, Agent, or Firm*—Wall Marjama & Bilinski

[57] ABSTRACT

Device for the formation of a fan jet (J) of liquid, of the type comprising:

means (3) for supplying a liquid;

means for distributing the delivery and for controlling the turbulence of the liquid supplied;

outlet means (4) for the fan jet (J) formed, characterized in that the means for distributing the delivery and for controlling the turbulence of the liquid supplied are formed:

from a first fixed curved conduit (15) for the flow of the liquid;

from a second curved conduit (25) having an axis parallel to that of the first conduit (15);

from means (26) for forming calibrated vortices having an axis parallel to the curved flow, so as to bring about a harmonic transverse distribution of the speeds and pressures and to control the scale and level of the vortices.

Planned uses: headbox of a paper machine or installation for the couching of paper.

10 Claims, 5 Drawing Sheets

DEVICE FOR FORMATION OF A FAN JET OF LIQUID

TECHNICAL FIELD

The invention relates to a device for the formation of a fan jet of a liquid; it relates more particularly to the formation of such a fan jet in the field of the mixing, couching, coating and manufacture of materials in the form of sheets or boards from particles in suspension in a fluid, especially from suspension of fibers in water.

The invention is particularly suitable for the papermaking industry in the formation of the sheet from fibrous suspensions; it also has various uses in the field of coating and in the couching of papers and cardboards.

Although, in the rest of the description, the invention is particularly described in its use for the manufacture of papers, it can also have other uses in mixtures, with or without heat exchange, in the chemical, agricultural food and pharmaceutical industries or in water treatment and in the manufacture of films from polymers or from molten metals or in the manufacture of asbestos cements.

PRIOR ART

In the manufacture of papers and cardboards, the fibrous suspension is converted into a jet of pulp emerging from the headbox.

As is known, a headbox must essentially ensure a uniform and homogeneous jet in the outlet nozzle, whilst reducing the irregularities in speed, pressure and concentration originating from the pulp feed distributor. Whatever the pulp feed device, a headbox must essentially ensure the following principal properties:

uniformity of the thickness of the jet;

constant speed at the outlet nozzle;

homogeneity in the fiber concentrations;

and, if possible, control of flocculation.

These properties must be stable in space, especially in the cross direction, and in time (that is to say, in the direction of travel of the jet), so that the gsm substance of the sheet remains constant and homogeneous.

If the lip opening is constant, any local variation in the gsm substance of the sheet originates either from a local speed variation or from a variation in concentration caused by the flocculation or even from both at the same time.

When the speed in the jet varies, this causes a variation in the material quantity, which may introduce variations of the order of 1 to 5% in time and over the width of the formed sheet.

The variations in speed in the cross direction are non-turbulent in origin. They may be random if the surface state of the outlet nozzle is perfect, otherwise they may be stationary. Attempts have therefore been made to render the pressure in the outlet nozzle uniform so as to obtain a uniform distribution of the speed range. However, this adjustment is difficult to obtain over nozzle widths of the order of or greater than three metres.

As is known, the fluctuations in fiber concentration are linked to flocculation, the intensity of which depends essentially on the hydrodynamic turbulence generated in the headbox. This turbulence causes the dislocation of the flocks. Thus, the vortices of small size, that is to say those of which the size is smaller than that of the flocks, dislocate the flocks to individual fibers, whilst the large vortices carry the flocks along in their movement. It is therefore an interaction of these two types of vortices relative to one another, and this may cause reflocculation.

The headboxes designed for high-concentration formation must be efficient at low concentration [sic]. In fact, the capacity to deflocculate a concentrated system and maintain it in the free jet must make it possible to produce perfectly homogeneous flows with concentrations currently adopted.

To obtain this result, use is generally made of the principle of generation of conventional turbulence, with variances to a greater or less extent for dislocating the flocks. However, conventional turbulence is not sufficient for a complete dislocation of the flocks. Moreover, the hydrodynamic boundary layer in the outlet nozzle, which is involved especially in the distribution of the speeds in the jet, is not taken into account in the design of the headboxes.

The invention overcomes these disadvantages.

It is aimed at a device of the type in question, making it possible to generate a special turbulence, in which the size of the vortices is calibrated according to a discrete law over the entire length of flow in the device.

The invention is aimed more particularly at a headbox capable of generating vortices making it possible to ensure the dislocation of the flocks under better conditions, especially as a result of a rotational elongation effect known by the English term "swirling".

PRESENTATION OF INVENTION

This device for the formation of a fan jet of liquid, of the type comprising:

means for supplying a liquid;

means for distributing the delivery and for controlling the turbulence of the liquid supplied;

outlet means for the formed fan jet, is characterized in that the means for distributing the delivery and for controlling the turbulence of the liquid supplied are formed:

from a first fixed curved conduit for the flow of the liquid;

from a second curved flow conduit having an axis parallel to that of the first conduit;

and from means for forming calibrated vortices having an axis parallel to that of the curved conduits, so as to bring about a harmonic transverse distribution of the speeds and pressures and to control the scale and level of the vortices.

This device is particularly suitable for the processing of fibrous suspensions in the papermaking industry.

In a preferred embodiment, the invention involves, in a headbox of a paper machine, introducing the fibrous suspension into two successive curved conduits having a parallel axis, especially coaxial, so as to form calibrated vortices having an axis parallel to the flow and therefore to the conduits, in order to bring about a harmonic transverse distribution of the speeds and pressures and consequently form a jet homogeneous in speed and with reduced flocculation, even at high concentration.

Advantageously, in practice:

the means for forming calibrated vortices consists of at least one rotary cylinder having an axis parallel to that of the two curved conduits;

the two curved conduits are arranged in series so as to produce a succession of scales and levels of turbulence which is suitable for the progressive deflocculation of the fibrous suspension.

The first outer fixed flow conduit produces calibrated vortices of a large scale suitable for the dispersion of the largest flocks.

The second inner flow conduit having an axis parallel to the first and associated with the rotary cylinder produces calibrated vortices of a small scale suitable for the dispersion of the smallest fiber flocks.

The rotary cylinder rotates in the same direction as the flow of the suspension, and the peripheral speed of the rotary cylinder is approximately three to four times higher than that of the speed of the flow, if pressure losses are to be minimized.

The rotary cylinder has a non-uniform surface state, for example one in which the generatrix follows a preferably regular, broken or wavy line.

Advantageously, the generatrix of the cylinder follows the shape of a radial sinusoidal groove, the wavelength of which is approximately two to ten times (preferably three to five times) the average length of the fibers.

Although the device usually comprises a single rotary cylinder, it may also comprise two of these having parallel axes.

In another embodiment, the device also comprises a deflector member arranged between the rotary cylinder and the outlet jet, in order to separate the flow between the supply and the outlet in the curved conduit.

In another embodiment, the device has means for the introduction of water, solutions or suspensions, which are arranged along a generatrix of at least one of the curved conduits, so as to regulate the concentration and composition of the pulp in the region of the jet.

In one alternative version, a composition (retention agents, fine elements, etc) different from the main suspension is introduced into this means, so as to produce an effective mixture of the various suspensions in the jet.

In another advantageous embodiment, at least two headboxes according to the invention are associated, if appropriate, with one or more conventional headboxes (multijet papers and cardboards).

Thus, the new headbox according to the invention is aimed at generating a special turbulence in which the size of the vortices is calibrated. The size of these vortices varies discretely or continuously over the entire length of flow. Thus, at the entrance of the box, first large-sized Dean vortices are generated in the first curved conduit, so as to dislocate the large flocks into smaller flocks. In the second curved conduit coaxial with the first, these flocks are reduced once again by smaller and smaller modified Taylor vortices, until complete dislocation occurs.

In the version with two parallel rotary cylinders, the size of these Taylor vortices is reduced even further in order to disperse the smallest flocks.

Since the intensity and size of the vortices are controlled over the entire length of these conduits, the flocculation/turbulence interaction is changed completely as a result of action of the turbulence on the flocculation. This device therefore makes it possible to obtain highly homogeneous suspensions, even at high concentration (four per cent and more), whatever the type of fibers.

Moreover, the lifetime of the generated vortices in the free jet is much greater than that of conventional turbulence used hitherto.

This parameter is important in the free jet, since relaxation, that is to say the reappearance of the flocks, depends greatly on this, in view of the fact that the generation of turbulence no longer occurs.

The implementation of the invention and the advantages arising from it emerge more clearly from the following exemplary embodiments, with reference to the accompanying figures.

EMBODIMENTS OF THE INVENTION

Figure 1:
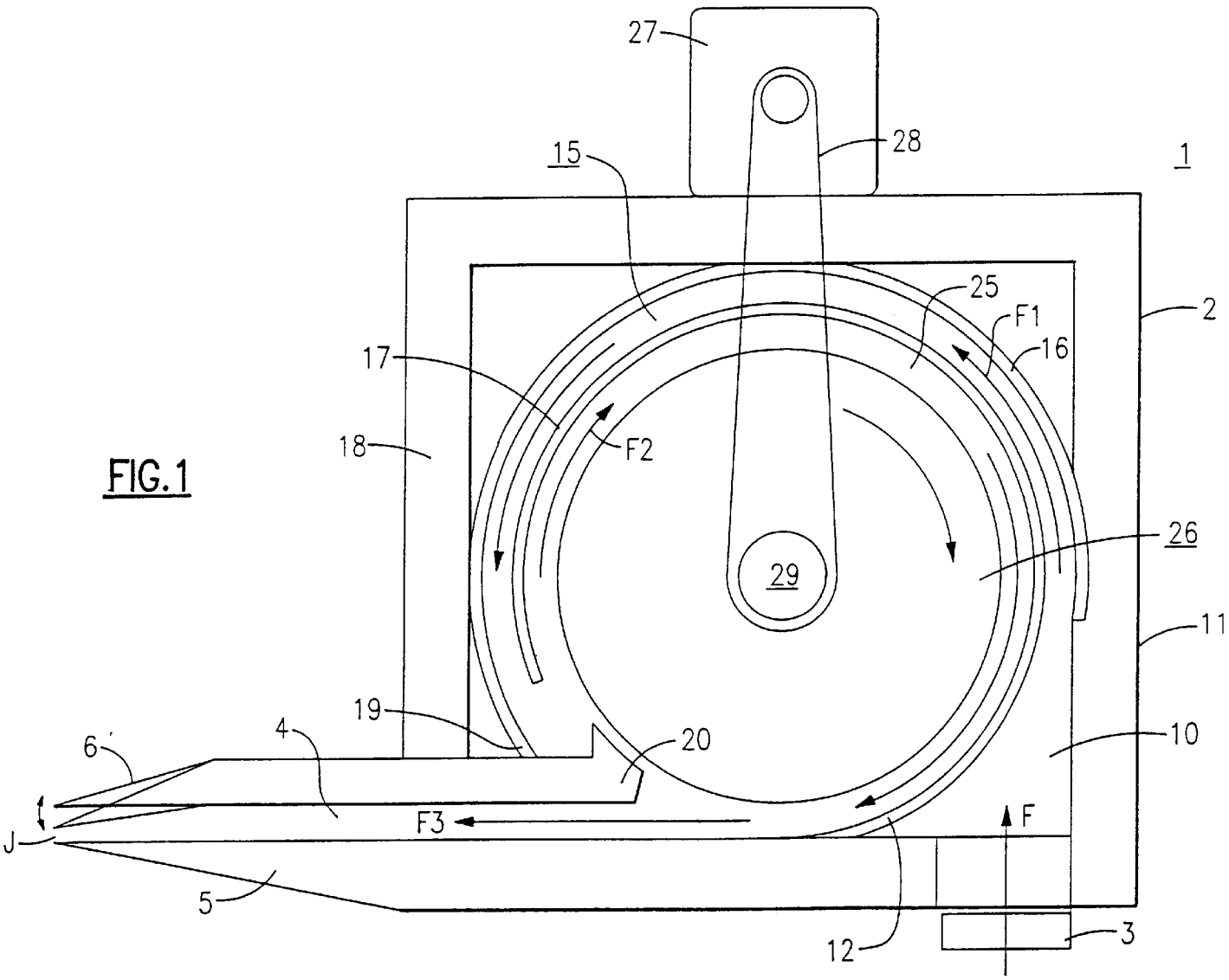
FIG. 1 is a representation of a device according to the invention when used in the headboxes for the manufacture of paper.

The headbox according to the invention, designated by the general reference (1), comprises an enclosure (2) connected at the bottom to a fibrous suspension supply pipe (3) used conventionally in the manufacture of papers or cardboards.

The enclosure (2) of parallelipipedic shape, for example of square cross section, has an outlet orifice (4), from which the fan jet (J) emerges. The outlet orifice (4) is advantageously formed in a known way from a lower fixed lip (5) and from an upper lip (6) adjustable relative to the lower lip (5), in order to adjust the dimension of the outlet.

According to a first characteristic of the invention, the supply pipe (3) opens into a first space (10) formed between a straight vertical wall (11) and a curved portion (12), in such a way that the thickness of the stream of liquid fluid (F) decreases progressively.

According to a second characteristic of the invention, the liquid stream (F) penetrates into a first fixed curved flow conduit, designated by the general reference (15), formed from two respectively outer (16) and inner (17) curved coaxial plates in the extension of (12). In this conduit (15), large-sized Dean vortices are generated, which dislocate the large flocks into small flocks. The curved plate (16) extends all-round the enclosure (2) and, level with the wall (18) parallel to (11), is welded at (19) to the inlet (20) of the upper lip (6).

According to another characteristic of the invention, the device also comprises a second conduit, designated by the general reference (25), formed by the inner face of the curved plate (17), in such a way that the fibrous suspension (F2) be subjected to smaller and smaller modified Taylor vortices, until complete dislocation of the flocks occurs.

According to another essential characteristic of the invention, the device also comprises a cylinder (26) rotating about an axis (29) parallel to the axes (not shown) of the conduits (15 and 25), driven by a motor (27) by means of a belt (28).

The processed suspension (F3) penetrates into the outlet conduit (4) in order thereby to form the desired fan jet (J).

Thus, the intensity, level and size of the vortices are controlled over the entire length of flow (F1, F2, F3), thus causing action of the turbulence on the flocculation, instead of flocculation/turbulence interaction.

Figure 5:
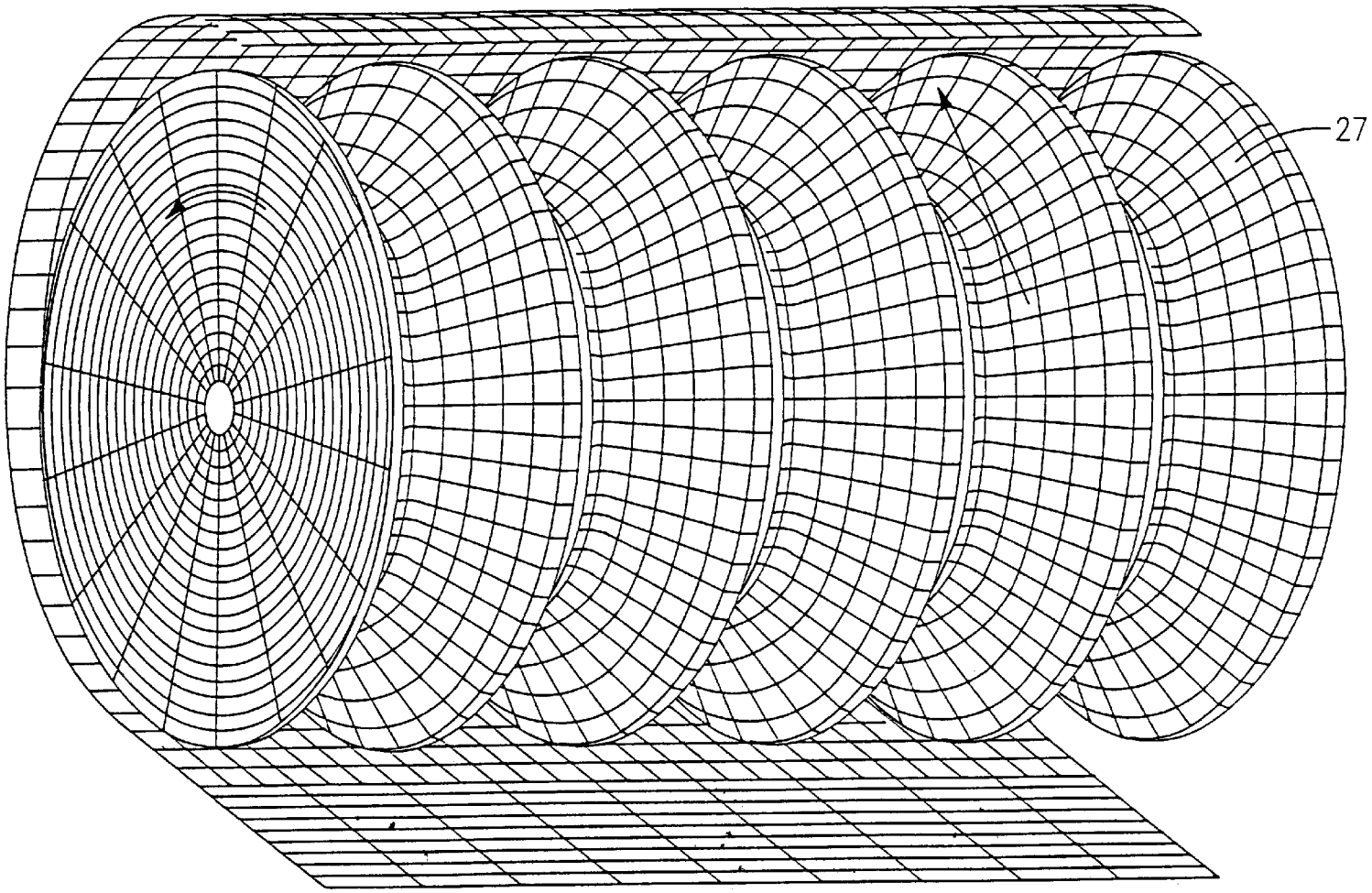
FIG. 5 is a partial cutaway side perspective view of the device according to the embodiment of FIG 1.
Figure 6:
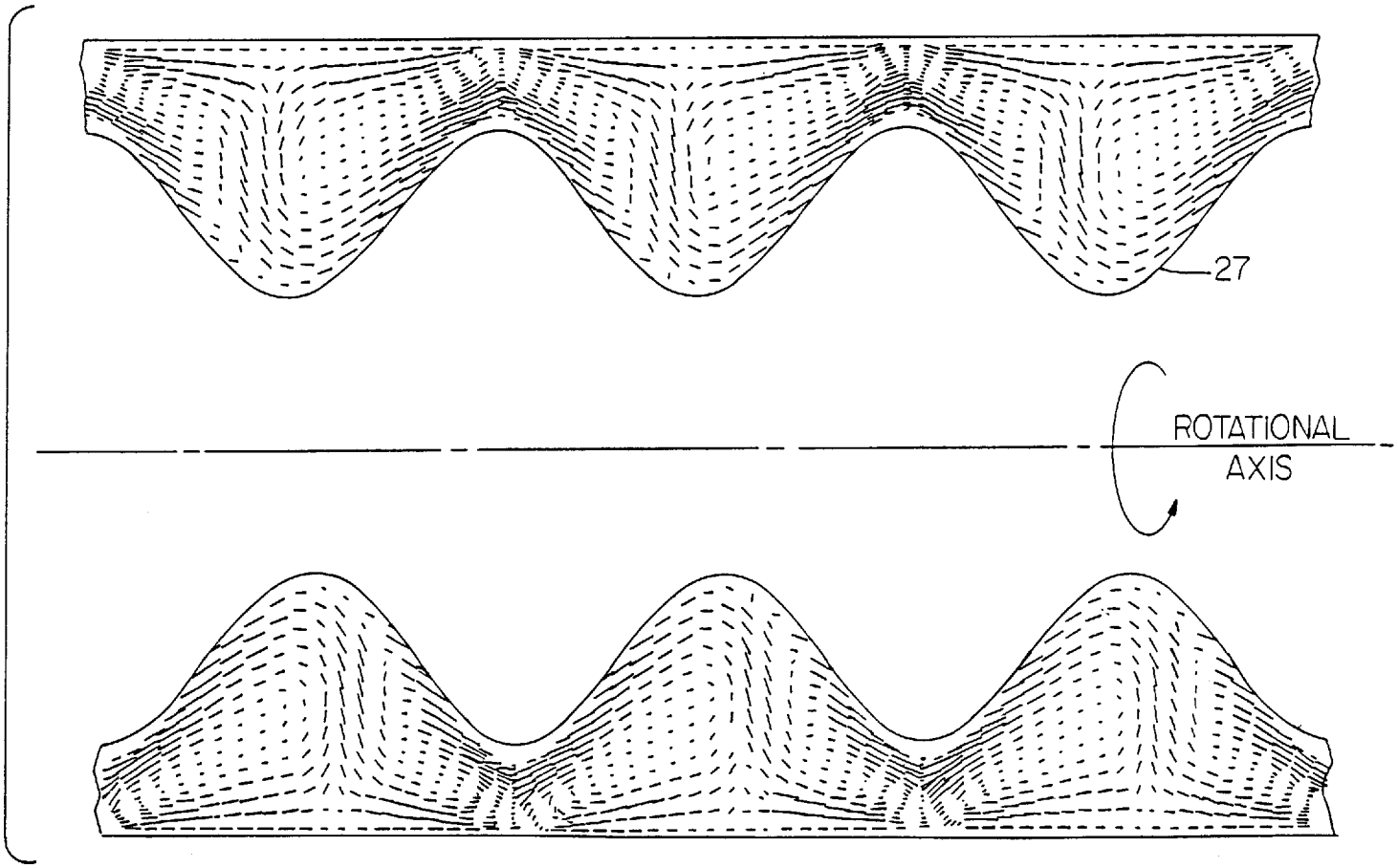
FIG. 6 is a partial side view of the cylinder shown in FIG.5

According to another characteristic of the invention, the rotary cylinder (26), which forms the confined space for shearing with the curved plate (17), has a generatrix (27), FIGS. 5 and 6, which is not a straight line, but varies harmonically.

This generatrix (27) can follow varied shapes, such as, for example, sawtooth, crenelated, in the form of arcs of a circle and preferably sinusoidal. As already stated, the wavelength of these shapes, for example sinusoidal, is of the order of three to five times the average length of the fibers of the suspension to be processed as shown in FIGS 5 and 6.

In an alternative version which is not illustrated, but is useful, the conduits (15 and 25) have a thickness decreasing in the direction of flow.

Figure 2:
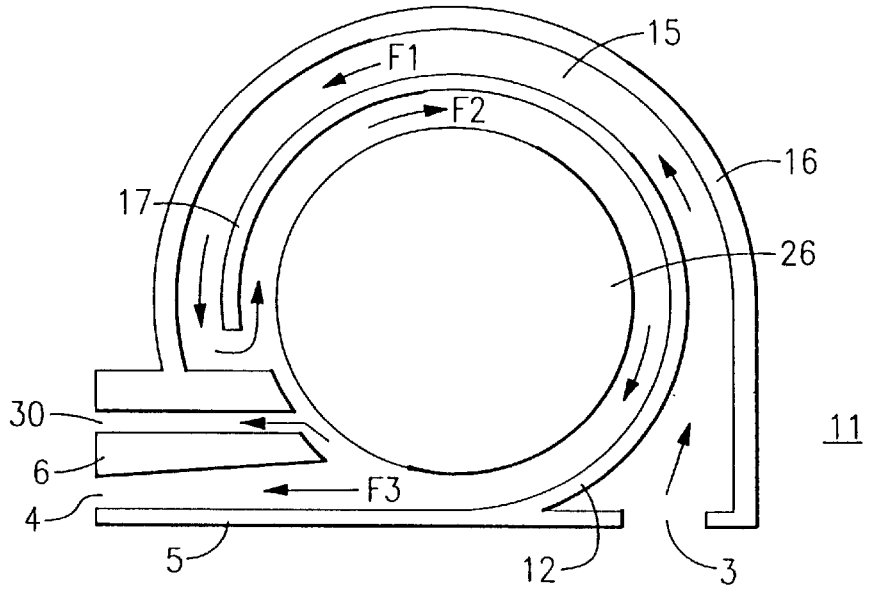
FIG. 2 is an alternative embodiment of FIG. 1 with recycling or dilution.

In the improved embodiment shown in FIG. 2, the outlet orifice (4) is associated with a parallel recycling or dilution outlet (30) arranged slightly downstream of (4), in order to make it possible to increase the delivery in the device and therefore the vorticity intensity, whilst at the same time increasing the speed of the rotating cylinder (26), without changing the outlet delivery (4) of the box.

When dilution is desired, the injection points of the water coincide spatially with the ondulations of the generatrix of the rotating cylinder (26).

In practice, the rotational speed of the characteristic cylinder (26) may vary from one to ten times the feed speed of the flow (F) in one direction or in the other.

Figure 3:
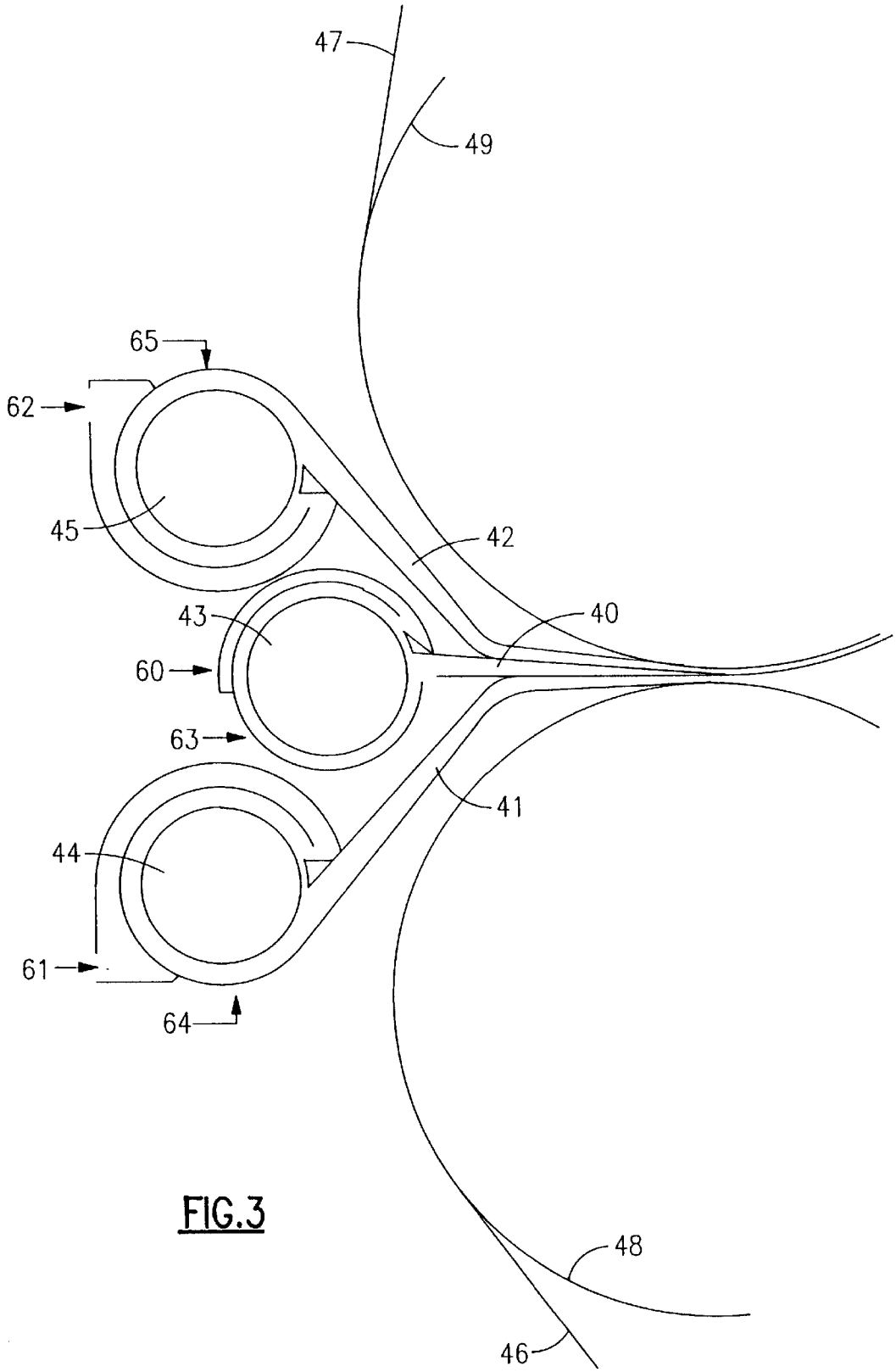
FIG. 3 is another embodiment of the invention, in which three devices are associated.

In the exemplary embodiment illustrated in FIG. 3, the device comprises three jets (40–42) emerging from three boxes according to the invention (43, 44, 45), into which are introduced various suspensions containing fibers of different length and/or of different concentration. The references (46, 47) designate a cloth, and the references (48, 49) designate two rotary cylinders of a paper machine.

The references (60, 61, 62) designate the pulp supply members, and the references 63, 64, 65) [sic] designate the dilution members.

This arrangement, which makes it possible to multilayer structure composed of different types and/or sorts of fibers, is advantageous when coarse fiber suspensions with high concentrations are used in the central supply device.

Figure 4:
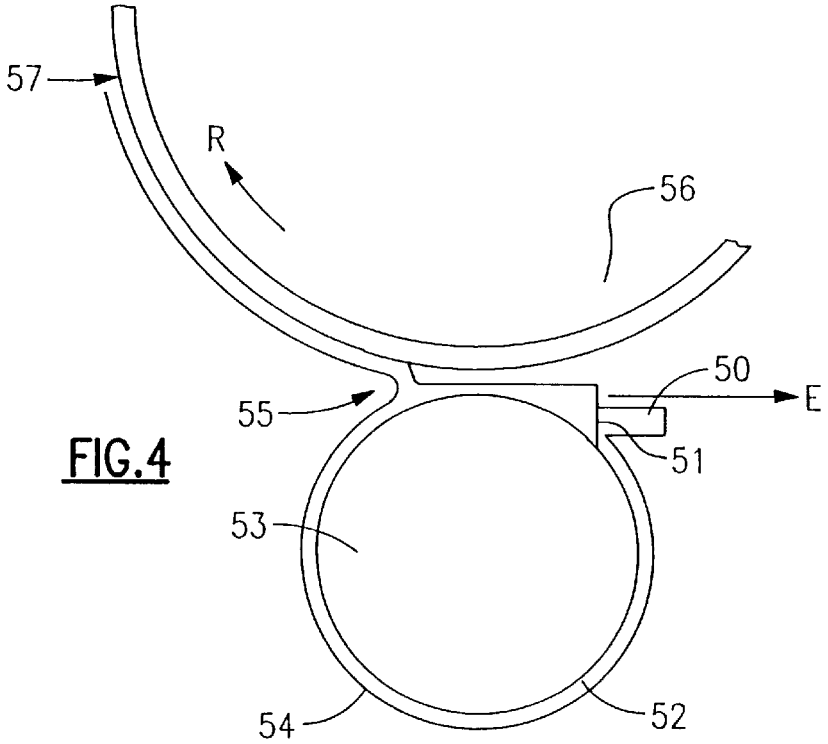
FIG. 4 is a diagrammatic representation of the invention, when it is used for the couching of the paper.

FIG. 4 shows diagrammatically an embodiment used for the couching of paper.

This device constitutes, in this case, a coating head which discharges a metered fan jet of couching slip (55) onto a cylinder (56) performing the function either of supporting the paper sheet (57) or of a transfer roller.

The coating slip (E) is supplied at (50), in order to be confined in a first curved conduit (52) formed between a rotary cylinder (53) similar to (26) and an outer plate (54) coaxial with (53). The curved conduit (52) has a constant cross section, for example rectangular.

This conduit opens at (55) into a space confined relative to the coating roller (56) rotating in the direction indicated by the arrow (R). The deflector (51) makes it possible to control and limit the recirculation of the slip in the conduit (52).

In practice, the tangential speed of the cylinder (56) is of the order of three times the discharge speed in the conduit (52).

The device according to the invention has numerous advantages, especially with regard to the headboxes known hitherto with high, normal or low concentrations. Mention may be made of:

the uniform speed distribution in the jet, whatever the device ensuring the feed of the pulp into the headbox, on account of the absence of a boundary layer and harmonic distribution of the relative pressure in the cross section, the intensity and wavelength of this harmonic variation being controlled perfectly;

a homogeneous suspension, even at high concentration, by virtue of the calibrated turbulence, the size of the vortices of which is adjusted over the entire length of flow of the pulp in the headbox;

the lifetime of the turbulence extended in the free jet as a result of the perfectly controllable intensity of the vorticity of the vortices.

This device can therefore be used successfully in the manufacture of papers, in headboxes, and also for the couching of paper.

We claim:

1. Apparatus for the formation of a jet liquid comprising:

a housing having a supply means through which a liquid flow enters the housing, means for distributing and controlling the flow of said liquid through said housing that further includes a first curved conduit and a second curved conduit in fluid flow communication with said first curved conduit, said first and second curved conduits being situated on a common axis, means for forming vortices in said first and second curved conduits to produce a harmonic speed and pressure distributed transversely therein and control the scale and level of said vortices, and an outlet means in fluid flow communication with said second curved conduit for discharging a formed fan jet of liquid from said housing, wherein said means for forming vortices includes at least one rotatable cylinder having an axis which is common with the axes of said curved conduits, said at least one cylinder having a generatrix following a shape selected from the group comprising sawteeth crenulations, arcs of a circle and sinusoids.

2. Apparatus according to claim 1 wherein the first and second curved conduit are stationarily mounted about said common axis and are mounted in a series flow relationship.

3. Apparatus according to claim 1 wherein the rotatable cylinder is arranged to turn about its axis in the same direction as the direction of flow of liquid through said second curved conduit.

4. The apparatus according to claim 1 wherein the peripheral speed of the rotary cylinder is between three and four times the speed of the liquid flow through said second curved conduit.

5. The apparatus of claim 1 that further includes deflector members arranged between the rotatable cylinder and the outlet means.

6. The apparatus of claim 1 wherein the liquid in said flow contains fibers in suspension suitable for use in the manufacture of paper.

7. The apparatus of claim 6 wherein the generatrix of the rotatable cylinder follows the shape of a radial sinusoid and the wavelength of said sinusoid is three to five times the average length of the fibers suspended in said liquid.

8. The apparatus of claim 1 wherein the periphery of at least one rotatable cylinder forms a wall of one of said curved conduits.

9. The apparatus of claim 8 wherein the second curved conduit is superimposed inside said first curved rotatable cylinder.

10. The apparatus of claim 9 wherein the periphery of said at least one rotatable cylinder forms an inner wall of the second curved conduit.

* * * * *